US007278637B2

(12) United States Patent
Huebl et al.

(10) Patent No.: US 7,278,637 B2
(45) Date of Patent: Oct. 9, 2007

(54) UNDERWATER MATCHING GAME

(76) Inventors: Steven Jerome Huebl, 22677 Redwing Ave., Jordan, MN (US) 55352; Darrin Mark Swagel, 3333 Zarthan Ave. So., St. Louis Park, MN (US) 55416

( * ) Notice: Subject to any disclaimer, the term of this patent is extended or adjusted under 35 U.S.C. 154(b) by 107 days.

(21) Appl. No.: 11/211,299

(22) Filed: Aug. 26, 2005

(65) Prior Publication Data

US 2007/0045956 A1 Mar. 1, 2007

(51) Int. Cl.
*A63F 3/00* (2006.01)

(52) U.S. Cl. ..... 273/273; 273/236

(58) Field of Classification Search ..... 273/273, 273/236

See application file for complete search history.

(56) References Cited

U.S. PATENT DOCUMENTS

| | | | | |
|---|---|---|---|---|
| 4,050,697 | A * | 9/1977 | Purviance | 273/139 |
| 5,190,296 | A * | 3/1993 | Sainsbury | 273/296 |
| 5,281,144 | A * | 1/1994 | Pease | 434/201 |
| 5,615,887 | A * | 4/1997 | Park | 273/272 |
| 5,810,364 | A * | 9/1998 | Canion | 273/459 |

* cited by examiner

*Primary Examiner*—Vishu K. Mendiratta
(74) *Attorney, Agent, or Firm*—Shehan, Phinney, Bass & Green, P.A.; Francis E. Marino

(57) ABSTRACT

A matching game for use in a swimming pool. Game pieces are provided which have various icons and point values on their faces and which are adapted to sink to the pool bottom and rest automatically in a face-down position on the pool floor. In alternating turns, players gather pairs of game pieces attempting to find matching pairs and accumulate scores according to the point values of matching pairs.

2 Claims, 3 Drawing Sheets

UNDERWATER MATCHING GAME

FIELD OF THE INVENTION

The present invention is an amusement game that relies on and challenges both the memory skills and physical capabilities of its players. More specifically, it is an underwater game that requires the players to dive one at a time into the water to locate and retrieve matching came pieces, and to thereby accumulate points. Players are rewarded according to their ability to maneuver and remain underwater, and according to their ability to remember the identity of the various game pieces located about the swimming pool floor.

BACKGROUND AND OBJECTS OF THE INVENTION

Matching games are well known. In a traditional card game named "Concentration", numerous playing cards, two of each denomination, are spread out face down on a tabletop. Two or more users take turns over turning two cards per turn. If the denomination of the second card selected in a turn matches the denomination of the first, a "match" is made and that player takes that matching pair, and gets an additional turn. When a turn does not result in a match, the cards are turned back face-down in their same locations and the next player gets a turn, but has the advantage of knowing the denominations and locations of the previous players' cards, if he can remember them. The player who accumulates the most pairs at the end of the game wins.

Various iterations of Concentration have been created over the years using various types of game pieces. At http://www.blackdog.net/games/misc/concentration, an Internet version of the Concentration game is found where electronic "cards" can be selected to reveal various icons in an attempt to obtain "matches". The icons include images of various cartoon animals and figures. This version of the game is played by a lone player who is rewarded once all of the pairs of icons have been matched by getting to see a hidden image underlying the game board.

At http://www.janbrett.com/piggybacks/mouse concentration.htm another Internet version of this traditional game is found which includes a time clock. In this version, icons of variously colored computer mice are unveiled when selected and a single player competed against his previous times taken to match all pairs.

The Primary object of the present invention is to adapt the basic principals of the traditional Concentration game to underwater fun.

Another object of the present invention is to incorporate swimming skills into the game.

Another object of the game is to incorporate the abilities of each player to hold his breath and remain under water for extended periods into the game.

Another object is to provide a game piece which can be used underwater and which will rest on the swimming pool floor.

Another object is to provide such a game piece that will sink to the bottom of the pool when cast into the water and, regardless of the position it has when it alights, will automatically settle into a face-down position on the floor of the pool.

Another object is to provide such a game piece that will return to its face-down position when it is released by a player after an unsuccessful turn.

Another object is to provide an improved scoring system which further rewards the player with the best memory by assigning various point values to various game pieces, so that players can obtain higher scores if they can remember not only where matching game pieces lie, but also where the more valuable game pieces lie.

Further objects and advantages of the invention will become apparent in view of the following description and explanation.

SUMMARY OF THE INVENTION

The present invention is a variation of the Concentration game for use in a swimming pool. Specifically, game pieces are provided which have indicia in the form of various icons and point values on their faces and which are adapted to sink to the pool bottom and rest automatically in a face-down position on the pool floor.

The pieces are initially cast about the pool and come to rest with the icons hidden from view. Two or more players take turns diving to the pool bottom and gathering a pair of game pieces. The pieces may either be viewed while underwater or are preferably brought to the water surface for viewing by all contestants to see if the icons on both pieces are the same and if a "match" is thereby made.

If a match has been made, the selecting player receives a score equal to the point value associated with that pair of pieces. Additionally, if a match is made, the selecting player gets an additional turn.

Continuing additional turns are received so long as the selecting player continues to make matches.

Both the selecting and waiting players are given a view of all selected pieces, and are therefore given an opportunity to know where those non-matching pieces lie when they are returned to the pool floor. So players with the best memories are rewarded with an advantage over players with lesser memories.

Also, as matching pieces might be found anywhere about the rather long and wide pool bottom, players with the most ability to remain underwater longer, and with the best underwater swimming skills, take additional advantage over those of lesser skill.

Alternatively, a lone player may compete against time to test and improve his memory and diving skills.

The sinking game pieces include both buoyant and ballast means which are positioned within a hollow housing such that an inherent imbalance is created that causes the pieces to be unstable whenever they alight face-up on the pool floor. This instability causes the pieces to immediately roll over into their stable-face-down position, hiding the icons on their faces from the players' view and making all of the game pieces appear identical to the players.

A better understanding of the invention will be realized upon a review of the following description of the invention's preferred embodiment, with accompanying drawings.

DETAILED DESCRIPTION OF THE PREFERRED EMBODIMENT

The matching game according to the preferred embodiment of the invention and its game pieces are depicted in FIGS. 1 through 5.

Figure 2:
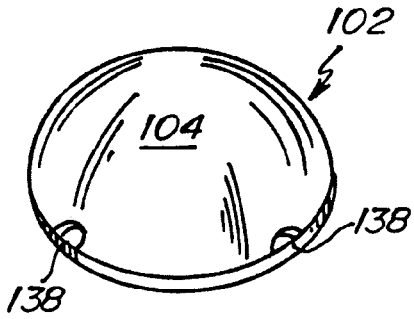
FIG. 2 is a top perspective view of a game piece according to the preferred embodiment of the invention in its stable face-down position on a swimming pool floor.
Figure 3:
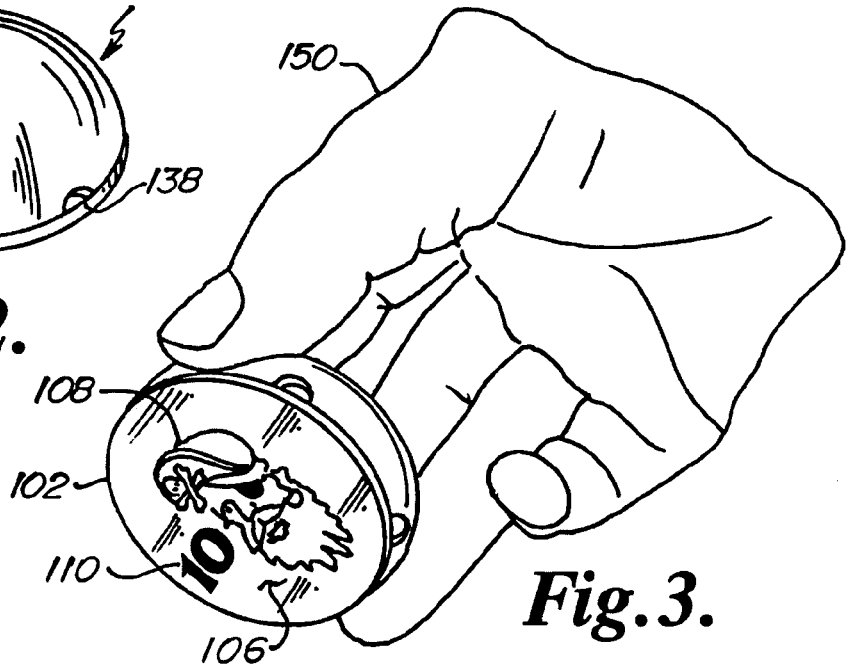
FIG. 3 is a view of a game piece being turned over by a selecting player to reveal the icon and score value on the piece's face.

Referring to FIGS. 2 and 3, game piece 102 has a frusto-spherical upper surface 104 and a flat lower face 106, on which is printed one of a variety of icons 108 and corresponding numerical values 110.

Figure 5:
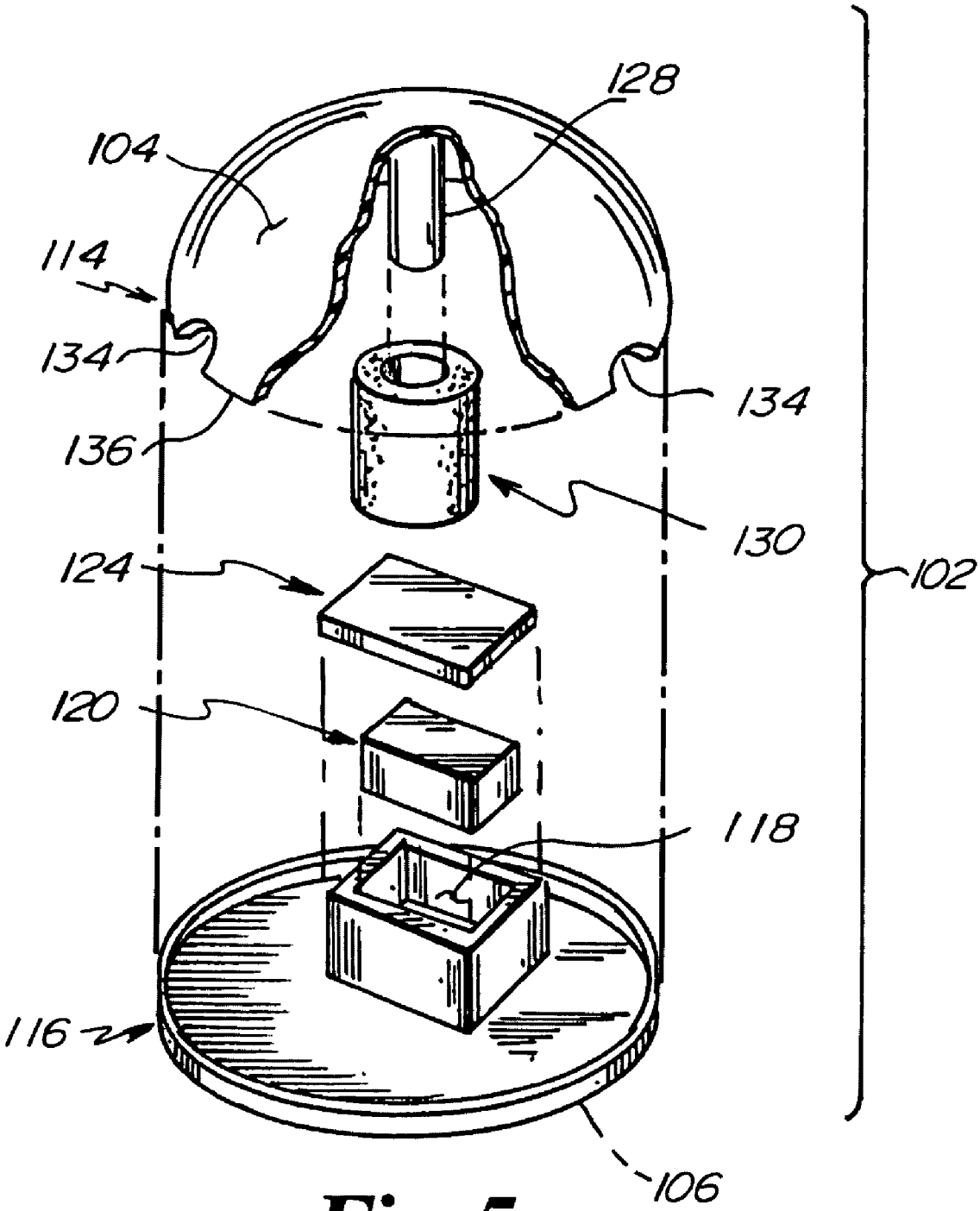
FIG. 5 is an exploded view of a game piece of the invention.

Referring to FIG. 5, game piece 102 is comprised of an upper housing 114, including the frusto-spherical upper surface 104, and a lower housing 116, including the flat lower face 106.

Lower housing 116 includes cavity 118 for receiving ballast 120. After insertion of ballast 120 into cavity 118, cover 124 is permanently affixed to the top of the cavity wall 126 to capture the ballast 120 within.

Upper housing 114 includes depending post 128 for receiving cylindrical float 130 thereon.

Upper housing 114 also includes vents 134 spaced evenly about its lower edge 136.

Upper and lower housings 114 and 116 are permanently affixed, as seen in FIG. 2, to capture float 130, and to create passages 138 through which air and water may pass.

Upper and lower housings 114 and 116, and cover 124 are made of a polymer material, preferably a styrene based polymer such as polystyrene or ABS, which is most suitable for solvent gluing, so that the affixation of these parts together forms a permanent and solid unit. Alternatively, these parts may be sonic-welded together or adapted for snap-fitting or attachment together with hardware.

The material of ballast 120 may be any dense material, and the ballast itself may either be a separate solid part that is inserted into the cavity 118 or may be poured into the cavity in a liquid state as say a molten polymer or a curable liquid, such as an epoxy, and hardened within the cavity.

The material of the float 130 is preferably a closed-cell polyethylene or EVA foam.

Figure 4:
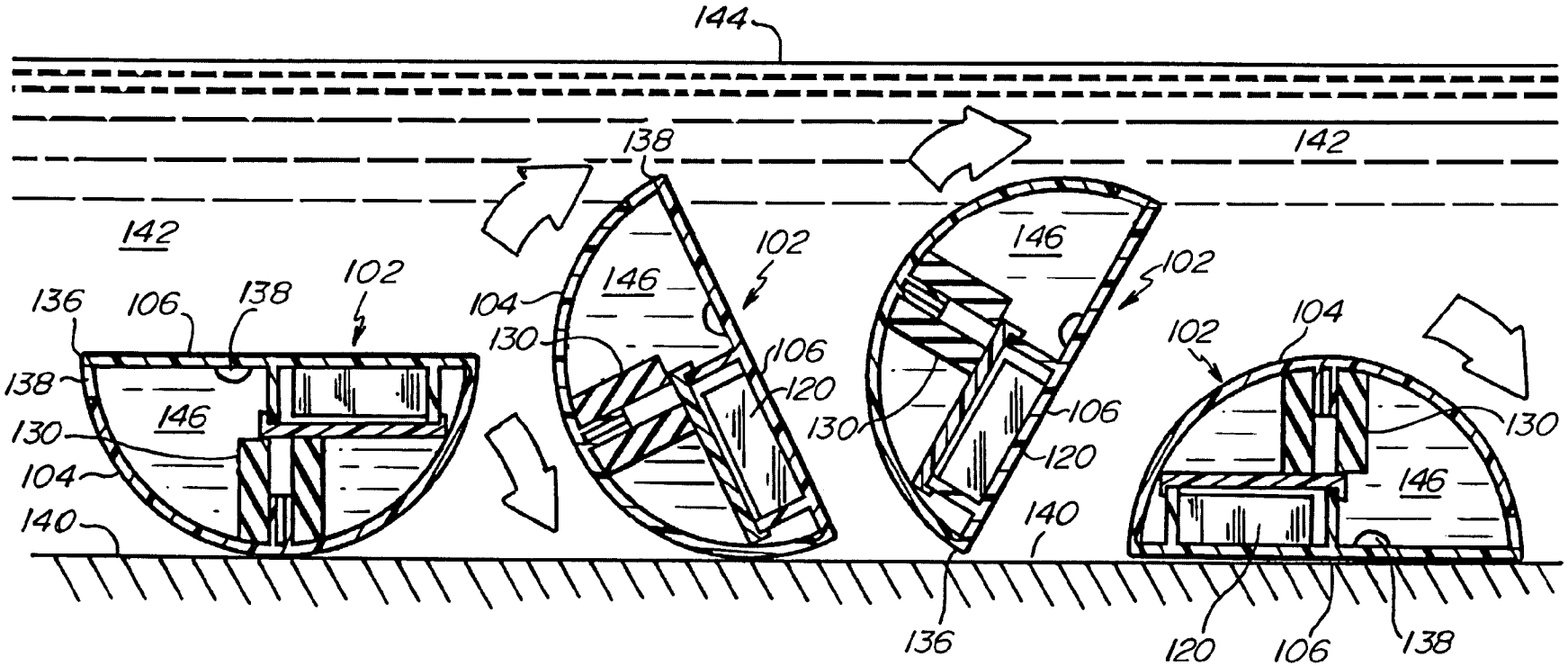
FIG. 4 is a progressive cross-sectional series view of a game piece tolling over automatically on the pool floor to a face-down position after initially alighting face-up.

Turning now to FIG. 4, it is shown how the frusto-spherical upper surface 104, float 130, ballast 120, and passages 138 cooperate to cause the game piece to turn-over and ensure that it always positions itself face-down on the pool floor 140.

When game piece 102 is cast into the water 142 of a pool 144, air from within the hollow interior 146 of the game piece 102 escapes through passages 138 and water 142 enters though the passages 138. Once the hollow interior 146 is water-filled, the game piece 102 becomes negatively buoyant and sinks to the bottom of the pool.

If the game piece 102 alights on the pool floor 140 in the face down position shown at the right in FIG. 4, it will remain in this stable face-down position.

If the game piece alights on the floor of the pool in the face-up position shown at the left in FIG. 4's the off-center location ballast 120 relative to the frusto-spherical surface 104 causes the game piece 102 to roll towards the ballast 120. As it does so, float 130 become off-center relative to the frusto-spherical surface, causing the game piece to roll even further in the same direction until the ballast 120 passes over the upper housing's lower edge 136, at which point the weight of the ballast causes the game piece to fall into the face-down position shown at the right in FIG. 4.

Any intervening position at which the game piece may initially alight on the pool floor will similarly result in the same final face-down position, by the same process.

Figure 1:
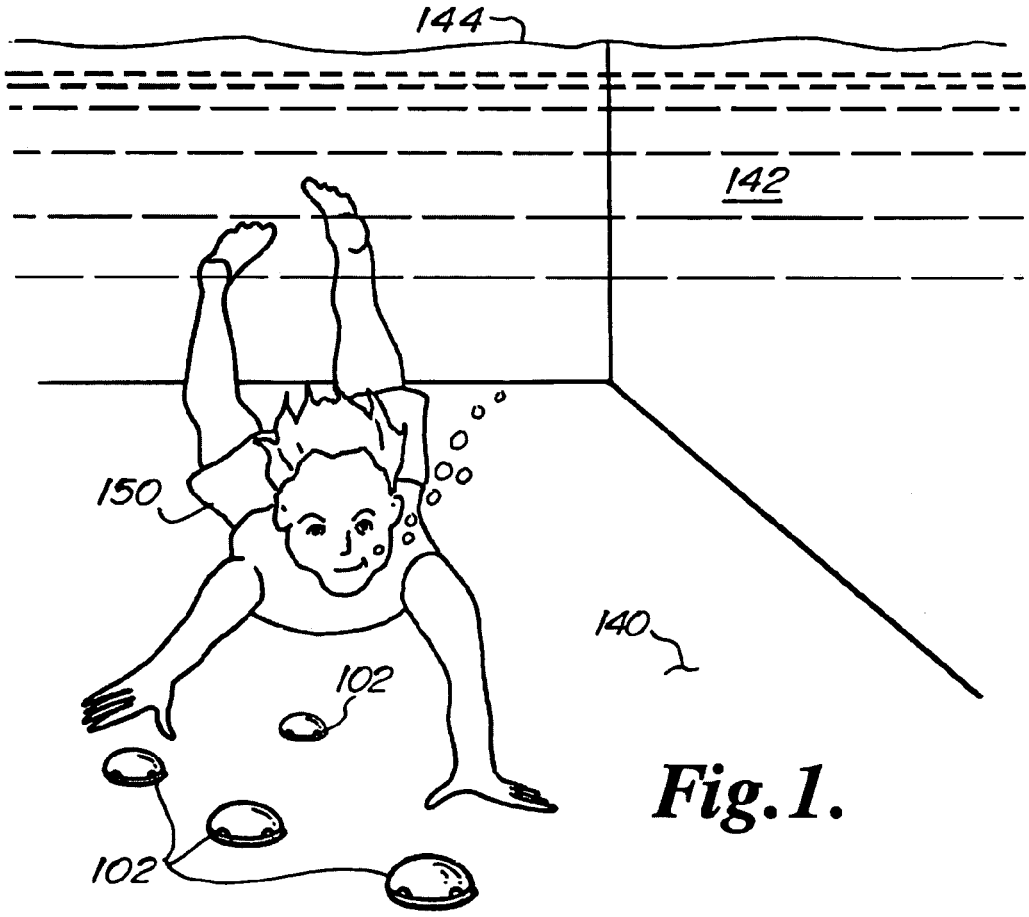
FIG. 1 is a view of a selecting player gathering game pieces from the swimming pool floor.

Referring now to FIG. 1, to play the game with two or more players, the game pieces 102 are initially cast into the pool and sink to face-down positions about the pool floor 140. One of the players 150 is selected to take the first turn and dives into the water to retrieve two game pieces. The selecting player must gather both pieces on a single dive, that being on a single breath of air. So the player having the ability to hold his breath longer has an advantage in the game.

The player brings the selected game pieces to the surface where both he and the other players can confirm whether or not the icons 108 on the two selected pieces match. If they do not match, the pieces are returned to the same approximate location on the pool floor, with all players having equal knowledge of the location and icon of those non-matching game pieces.

If those selected game pieces did match each other, the selecting player keeps them and receives a score equal to the numerical value 110 of the pieces, and the player continues his turn until he selected two non-matching pieces.

Over the course of the game, the number of non-matching selections accumulates and it becomes harder and harder for the players to remember what icons are in what locations around the pool. So the ability of one player to better remember provides an advantage in the game.

Also as the game progresses, fewer and fewer pieces are left on the pool bottom and they will likely be spread further and further apart, so the player who is most skilled at underwater swimming has an advantage in the game.

As can be appreciated, this game calls upon one's ability to remember where many game pieces of known identity are located, one's ability to hold one's breath for extended periods, and ones ability to maneuver underwater to succeed.

Alternatively, this game may be played in a bathtub.

The present invention has been described with respect to its preferred embodiment; however, other changes and modifications to the invention may be made which are still within the spirit and scope of the invention. Therefore, the invention should only be limited by the following claims.

We claim:

1. An underwater matching game comprising the steps of:

A. casting a plurality of matching pairs of sinking game nieces into water said game pieces each having an indicium marked on a face thereof, said indicium on a first piece of each marching pair being identical to said indicium on the second piece of said matching pair and said indicia of each matching pair being different from said indicia of at least some of said other matching pairs, wherein said game pieces sink to a solid bottom surface of the water into a position having said face disposed in a downward direction against the bottom surface such that said indicia are hidden from view, B. selecting an order of play among a plurality of players to establish a first player, through a last player, C. having first player enter the underwater to select two of said game pieces without viewing said indicia thereof underwater, D. having said first player bring said two of said game pieces to the above-water, E. haviug all players observe an unveiling of said two of said game pieces' indicia, F. returning said two of said game pieces to the underwater if they are not a matching pair, or awarding said two of said game pieces to said first player if they are a matching pair, G. having said first player continually repeat steps C through F if said two of said game pieces are a matching pair until a failure to select a matching pair occurs, or having a next player execute and continually repeat steps C through F until a failure to select a matching pair occurs, H. tallying said awarded matching pairs by each of said players to determine a score, with said player having the highest score being the game's winner, wherein said game pieces each cormprise:

a float, a ballast, and a frusto-spherical housing having a semispherical portion and said face, said face comprising a planar portion, and said float and said ballast are positioned within said housing, said float centrally disposed relative to said face and said ballast off-centrally disposed relative to said face, such that they cooperate to automatically overturn said game piece, from an unstable position having its semispherical portion disposed in a generally downward direction into a stable position wherein said face is so disposed in a downward direction, and wherein said game pieces are thereby adapted to always alight on said solid bottom surface with said face disposed in a downward direction against the bottom surface.

2. An underwater matching game comprising the steps of:

A. castine a plurality of matching pairs of sinking game pieces into water, said game pieces each having an indicium marked on a face thereof, said indicium on a first piece of each matching pair being identical to said indicium on the second piece of said matching pair and said indicia of each matching pair being different from said indicia of at least some of said other matching pairs, wherein said game pieces sink to a solid bottom surface of the water into a position having said face disposed in a downward direction against the bottom surface such that said indicia are hidden from view, B. initiating a timer, C. having solitary player enter the underwater to select two of said game pieces without viewing said indicia thereof underwater, D. having said solitary player bring said two of said game pieces to the above-water, E. having said solitary player unveil said two of said game pieces' indicia, F. returning said two of said game pieces to the underwater if they are not a matching pair, or accumulating said two of said game pieces above-water if they are a matching pair, G. having said solitary player continually repeat steps C throught F until all of said matching pairs of said game pieces have been accumulated, H. Terminating said timer and observing the time taken to accumulate all of said matching pairs, wherein said game pieces each comprise:

a float, a ballast, and a frusto-spherical housing having a semispherical portion and said face, said face comprising a planar portion, and said float and said ballast are positioned within said housing, said float centrally disposed relative to said face and said ballast off-centrally disposed relative to said face, such that they cooperate to automatically overturn said game piece, from an unstable position having its semispherical portion disposed in a generally downward direction into a stable position wherein said face is so disposed in a downward direction, and wherein said game pieces are thereby adapted to always alight on said solid bottom surface with said face disposed in a downward direction against the bottom surface.

* * * * *